US009297152B2

(12) United States Patent
Alexander

(10) Patent No.: US 9,297,152 B2
(45) Date of Patent: Mar. 29, 2016

(54) INTERNALLY MOUNTABLE WATER FLOW DEVICE

(71) Applicant: Kerei Alexander, Merritt Island, FL (US)

(72) Inventor: Kerei Alexander, Merritt Island, FL (US)

( * ) Notice: Subject to any disclaimer, the term of this patent is extended or adjusted under 35 U.S.C. 154(b) by 246 days.

(21) Appl. No.: 14/068,829

(22) Filed: Oct. 31, 2013

(65) Prior Publication Data

US 2014/0374513 A1 Dec. 25, 2014

Related U.S. Application Data

(60) Provisional application No. 61/837,302, filed on Jun. 20, 2013.

(51) Int. Cl.
*G01F 1/42* (2006.01)
*E03C 1/08* (2006.01)

(52) U.S. Cl.
CPC ..... *E03C 1/08* (2013.01); *Y10T 29/49428* (2015.01)

(58) Field of Classification Search
CPC ..... F16K 47/10; F16L 55/027
USPC ..... 138/40, 45, 44; 137/801; 251/118
See application file for complete search history.

(56) References Cited

U.S. PATENT DOCUMENTS 2,501,593 A * 3/1950 Becker ..... F16L 55/00 138/44
2,804,928 A * 9/1957 Farrar ..... E21B 21/10 138/40
3,311,131 A * 3/1967 Zahuranec ..... F16L 39/00 138/44
3,786,995 A 1/1974 Manoogian et al.
4,105,721 A * 8/1978 Schliebe ..... B01F 5/0413 138/44
4,412,431 A * 11/1983 Waldrep ..... F25B 41/06 138/44
4,644,974 A * 2/1987 Zingg ..... B24C 5/04 138/40
5,673,724 A 10/1997 Abel
5,937,909 A * 8/1999 Clauss ..... F02M 59/466 138/43
6,219,856 B1 * 4/2001 Alles ..... E03C 1/08 137/441
6,390,134 B1 * 5/2002 Hanby ..... B23K 9/32 138/44
6,843,508 B2 * 1/2005 Cords ..... F16B 39/30 285/148.19

* cited by examiner

*Primary Examiner* — Patrick F Brinson
(74) *Attorney, Agent, or Firm* — Jason T. Daniel, Esq.; Daniel Law Offices, P.A.

(57) ABSTRACT

An internally mountable water flow device includes a water restriction element having a first end, a second end and a middle section, through which a centrally located aperture is provided. One or more gaskets are disposed adjacent to the first end of the restriction element, and a tightening member having a plurality of threaded elements functions to engage the restriction element and impart a pressure onto the one or more gaskets.

9 Claims, 8 Drawing Sheets

INTERNALLY MOUNTABLE WATER FLOW DEVICE

CROSS-REFERENCE TO RELATED APPLICATIONS

This application claims the benefit of U.S. Provisional Application Ser. No. 61/837,302 filed on Jun. 20, 2013, the contents of which are incorporated herein by reference.

TECHNICAL FIELD

The present invention relates generally to water conservation devices, and more particularly to an internal expansion flow device for adjusting water volume and flow emanating from a water source.

BACKGROUND

The statements in this section merely provide background information related to the present disclosure and may not constitute prior art.

Owing to the decline in the availability of fresh water, many communities across the globe are turning to water rationing and/or "green" technologies in an effort to conserve this precious resource. One of the most commonly utilized water conservation devices is the faucet aerator.

FIGS. 1A and 1B illustrate a conventional faucet aerator 5, which includes a main body 5*a* having a water input section 5*b* and a water output section 5*c*. As shown, the water input section includes threaded elements 6 for mating with a conventional faucet 1, and the water output section includes a screen 6 having dozens of tiny holes 6*a*.

Although generally considered useful devices, conventional faucet aerators suffer from many practical drawbacks. One such drawback includes their propensity to collect calcium deposits emanating from the water. To this end, many faucet aerator screens are constructed from nylon or other such materials which attract calcium. As calcium builds up on the surface of the screen, water is not able to effectively emanate from the plurality of tiny openings, and over time the faucet begins to have a reduced and/or erratic spray pattern.

In addition to the above, by positioning the aerator outside of the faucet at a location that is easily accessible to users, it becomes difficult to prevent the devices from being removed. Such occurrences are particularly troublesome to landlords and public buildings wherein repeated use of faucets by members of the public results in astronomical utility bills.

Accordingly, there remains a need for an internally mountable water flow device that can function to provide consistent water output pressure while reducing the overall flow of water from a faucet and that does not suffer from the drawbacks of the above noted devices.

SUMMARY OF THE INVENTION

The present invention is directed to a water flow device for positioning within a channel of an existing water faucet. One embodiment of the present invention can include a water restriction element having a first end, a second end and a middle section, through which a centrally located aperture is provided. One or more gaskets are disposed adjacent to the first end of the restriction element, and a tightening member having a plurality of threaded elements functions to engage the restriction element and impart a pressure onto the one or more gaskets.

When disposed within a channel of a faucet, the gasket can expand until forming a watertight seal thereby locking the device into place. At this time, water can pass through the aperture which has been constructed to increase water pressure and decrease the volume of water which can pass therethrough.

Another embodiment of the present invention can include another water restriction element having a generally circular shape, a central aperture and a thickness. The other water restriction element being positionable between a water source such as a spigot, and a water delivery element such as a hose.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
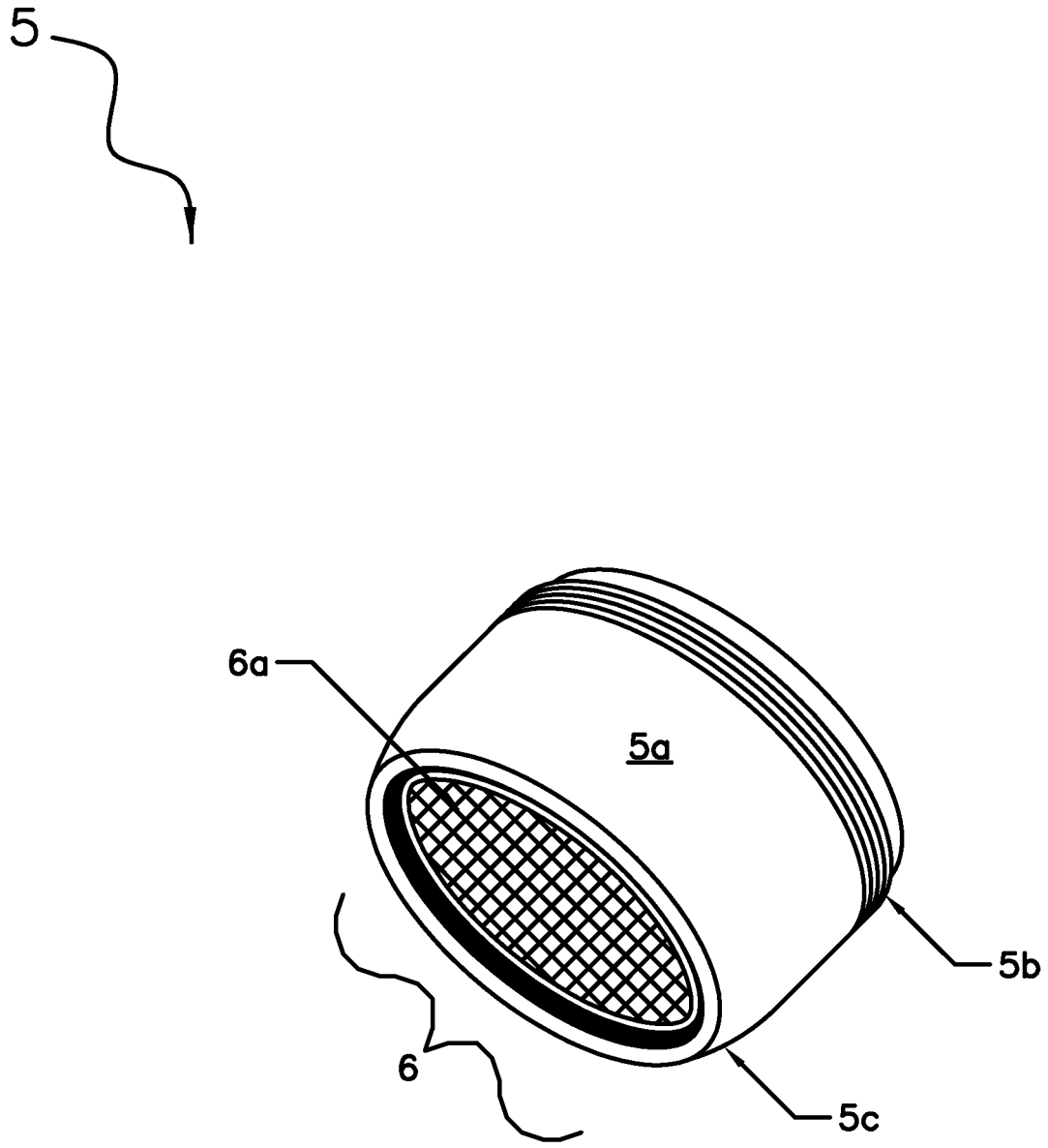
FIG. 1A is a perspective view of an aerator in accordance with background art.
Figure 1B:
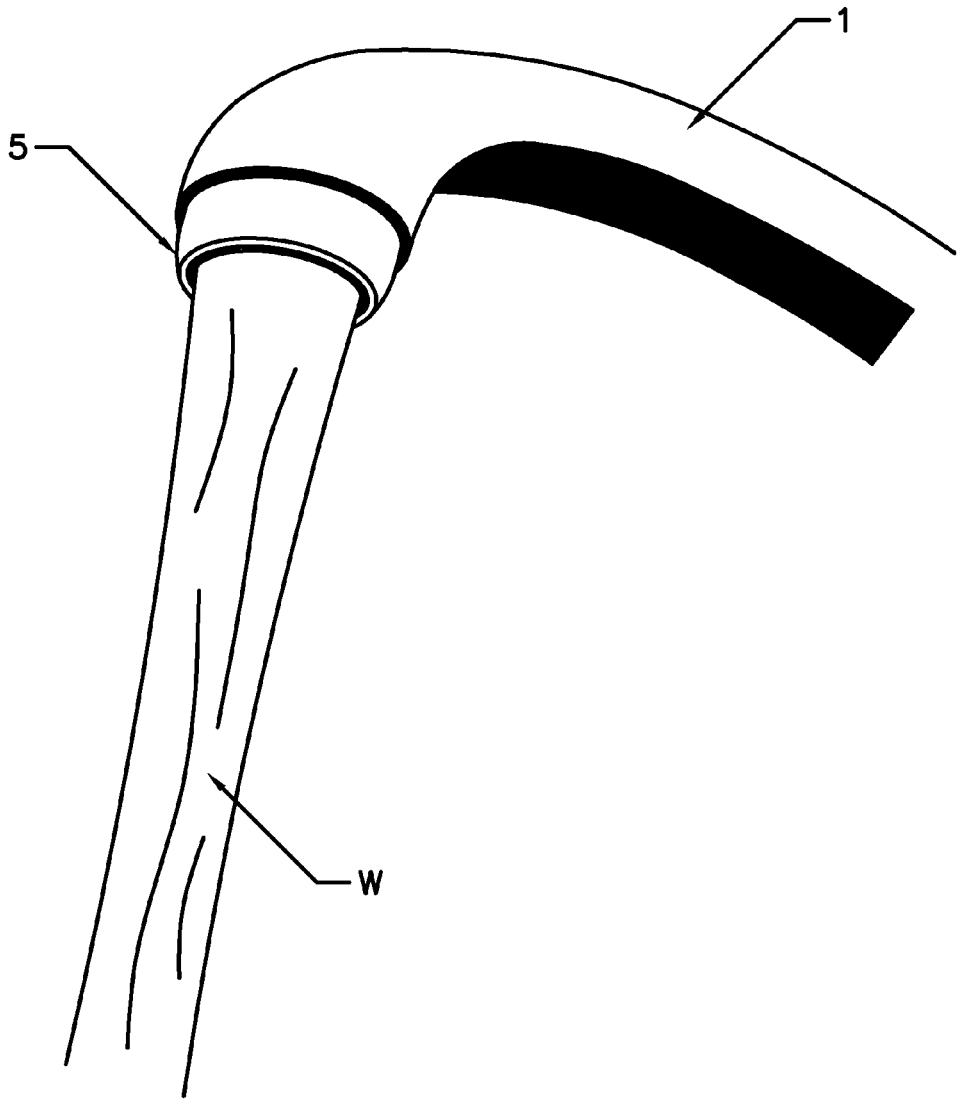
FIG. 1*b* is a perspective view of the aerator of FIG. 1*a* in operation, in accordance with background art.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 2B.

As will be described below, an internally mountable water flow device can be installed within a channel or other such pathway of a new or existing water faucet so as to increase water pressure and reduce the overall flow of water exiting the faucet. Although described throughout this document as pertaining to sink faucets, this is for exemplary purposes only. To this end, the term "faucet" can include any item that dispenses water, such as sprinklers, spigots, drinking fountains and the like.

Figure 2A:
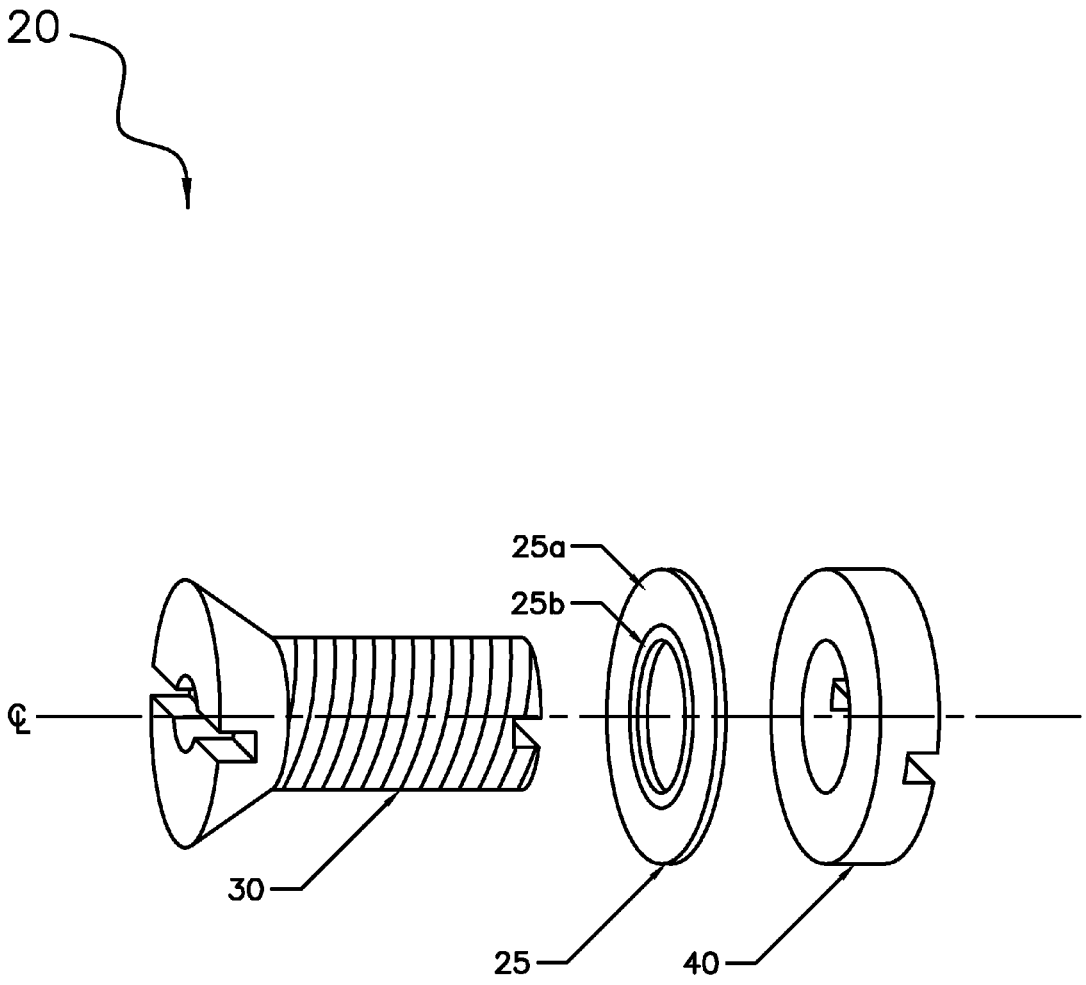
FIG. 2A is an exploded parts view of an internally mountable water flow device that is useful for understanding the inventive concepts disclosed herein.

FIG. 2A illustrates an exploded parts view of one embodiment of an internally mountable water flow device 20, that includes an internal flow restriction element 30, a tightening member 40 and at least one gasket 25.

Figure 2B:
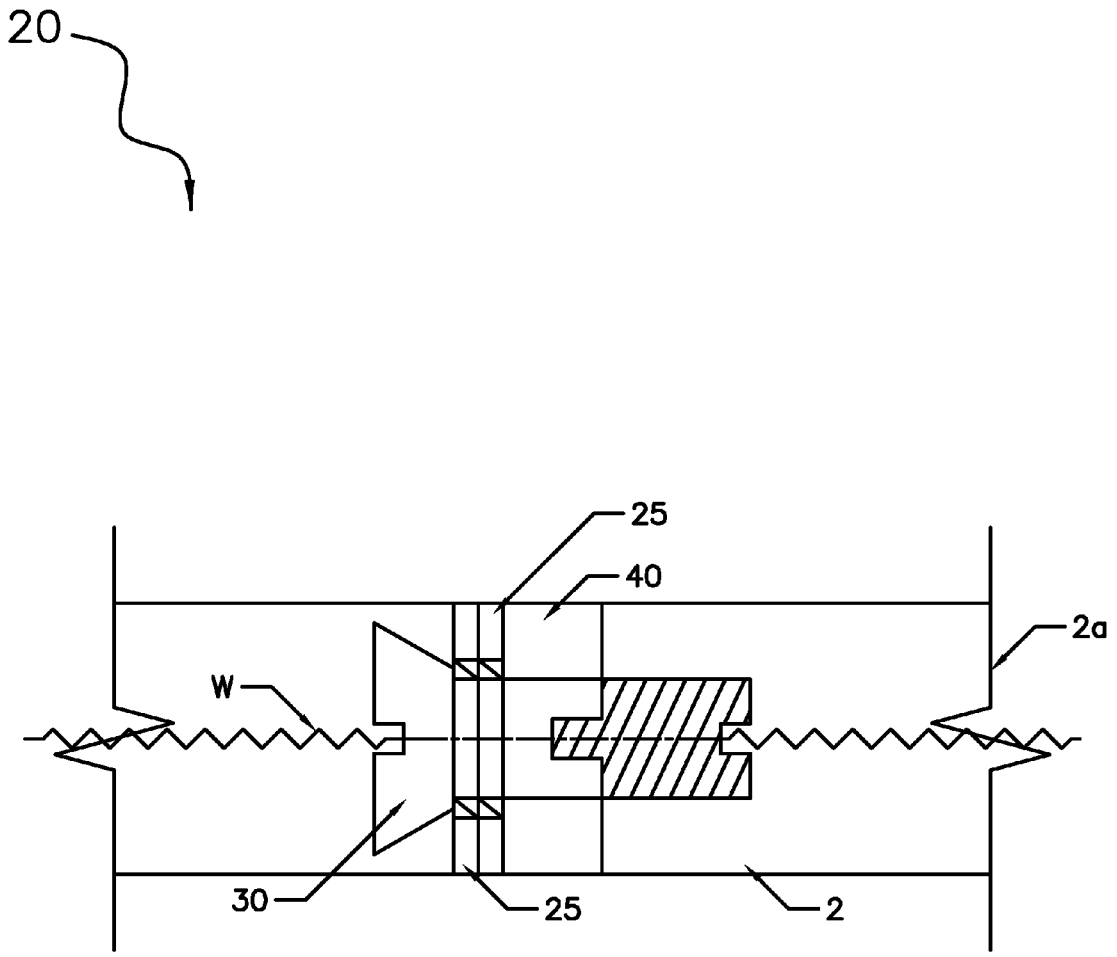
FIG. 2B is a side view of the internally mountable water flow device in an assembled manner, in accordance with one embodiment of the invention.

As shown in FIG. 2B, the device 20 can be installed within a channel 2 of a faucet 1, and can act to increase the pressure of water W while lowering the flow of water leaving the channel 2*a*. As described herein, the channel 2 can include any pathway within a fixture such as a faucet, spigot or sprinkler, for example through which water passes. The most common sizes of these channels include an inside dimension ranging between approximately 0.4 inches to 2 inches, for example, depending on the intended use of the faucet.

Figure 3:
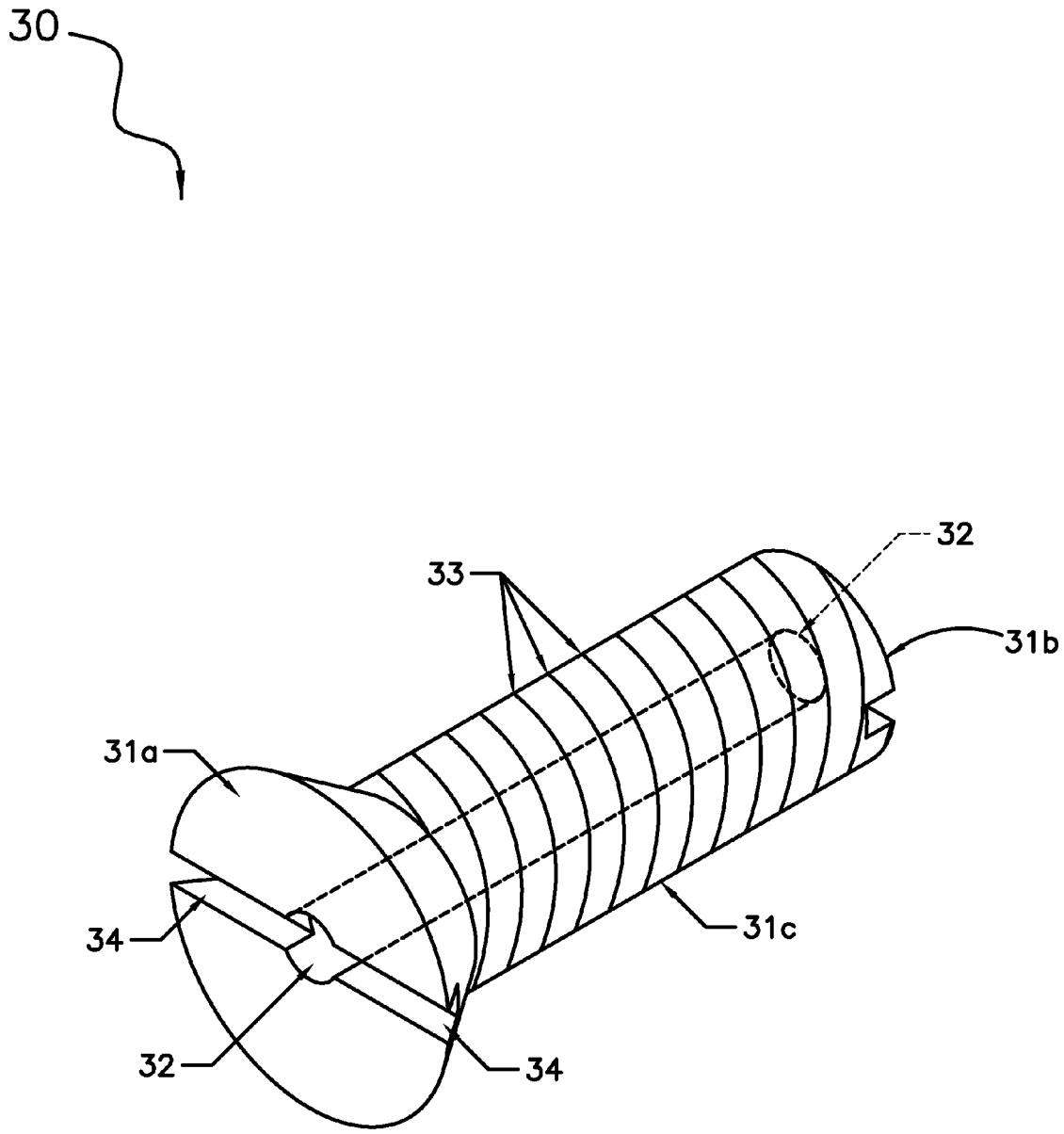
FIG. 3 is a perspective view of the flow restriction element of the internally mountable water flow device, in accordance with one embodiment of the invention.

FIG. 3 illustrates one embodiment of the internal flow restriction element 30 for use with the device 20. As shown, the element 30 can include an elongated member having a first end 31*a*, a second end 31*b* and a middle section 31*c* having a plurality of threaded elements 33 disposed thereon. An elongated aperture 32 is disposed within the main body and extends from the first end to the second end.

The first end 31*a* of the restriction element 30 will preferably include a dimension that is slightly (0.1 to 0.01 inches, for example) less than an inside dimension of a channel 2 into which the device is to be placed, so as to allow the restriction element to be positioned therein. The first end can also include a pair of opposing channels 34 for receiving a tool (such as a flat head screwdriver, for example) so as to allow the restriction element to be rotated by a tool such as a flat head screwdriver, for example. Of course, any number of other channels can be provided onto the end of the element so as to engage other types of tools.

In one preferred embodiment, the aperture 32 can include an inside diameter of 0.094 inches, and can function as a pathway through which water can flow when the device is in use. However, any number of other dimensions suitable for allowing water to flow there through at any desirable flow and pressure level are also contemplated. To this end, the diameter of the aperture 32 can be constructed based on known calculations relating to thermodynamics and can factor elements such as the PSI of the water source, the size of the water delivery mechanism and/or the size of the channel 2, among other factors.

The internal flow restriction element 30 can preferably be constructed from brass or stainless steel, for example, which are well suited for prolonged exposure to water, and have inherent properties that do not attract calcium. Of course, any number of other materials such as PVC, CPVC, Polybutylene, and PEX, for example, are also contemplated. To this end, the element 30 is designed to be removably inserted within an existing channel portion of an existing fixture in order to provide the inventive concepts disclosed herein to fixtures regardless of size, shape, material and manufacturer.

Figure 4:
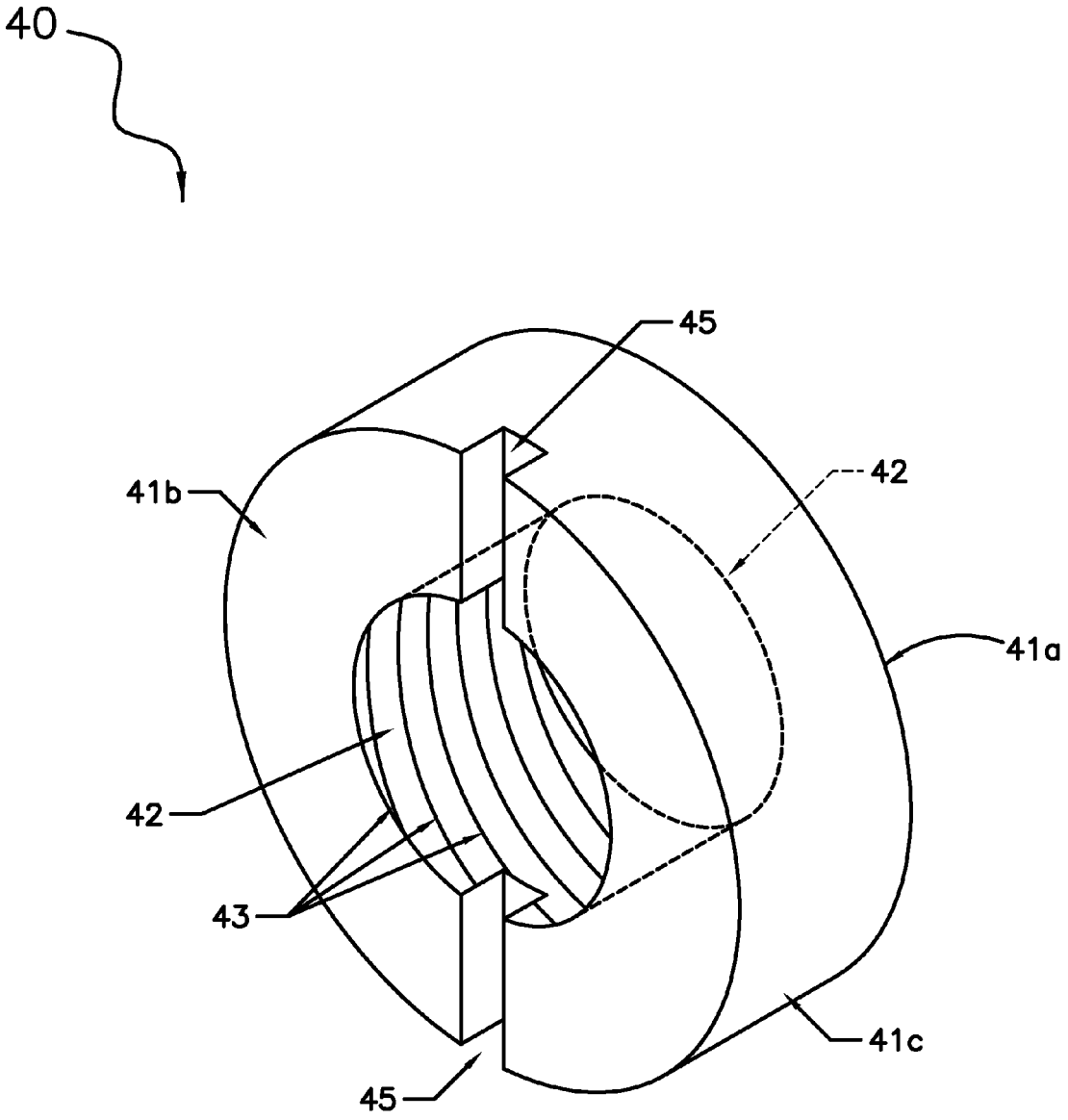
FIG. 4 is a perspective view of the tightening member of the internally mountable water flow device, in accordance with one embodiment of the invention.

FIG. 4 illustrates one embodiment of a tightening member 40 that includes a generally shortened member having a first end 41*a*, a second end 41*b* and a middle section 41*c*. The tightening member body can include an outside shape and dimension that is complementary to and slightly less than the inside dimension of the channel portion 2 of the fixture 1 into which the device will be installed. In this regard, the tightening member body will preferably include a snug fit wherein the body will not be so loose as to be able to move freely within the channel 2, but will be capable of moving when a force is applied thereto by a user.

As shown, an aperture 42 having a plurality of threaded elements 43 can be disposed within the main body extending from the first end to the second end (i.e., a threaded aperture). In this regard, the aperture 42 and threaded elements 43 can include dimensions that are complementary to the threaded portion 33 of the restriction element 30. As such, elements 33 and 43 can function in a conventional manner to secure the members 30 and 40 together when a twisting motion is imparted onto either element, whereby each of the members 30 and 40 can function to squeeze the gasket 25, as described below.

In one preferred embodiment, the second end 41*b* of the tightening member 40 can also include a pair of opposing recesses 45. These recesses can work with an adjustment tool (not illustrated) having a fork-like shape that includes an elongated shaft and a pair of protruding edges for allowing a user to engage the recesses 45 to tighten (i.e., move the member 40 toward the first end 31*a*) or to loosen (i.e., move the member 40 toward the second end 31*b*) the device. As described herein, when the tightening member has applied a sufficient force upon the one or more gaskets so as to cause the gaskets to expand within the channel and create a waterproof barrier, the device is in a closed position.

The tightening member 40 can also be constructed from any material suitable for prolonged exposure to water and moisture, such as PVC, CPVC, Polybutylene, PEX, and metals such as brass, copper, aluminum and stainless steel, among others, for example.

The device can also include one or more gaskets 25 that are preferably constructed from an elastomeric material such as rubber or a rubber-like substance that are resilient and able to expand when a compressive force is applied thereon, and that are also suitable for prolonged exposure to water and moisture, while maintaining the ability to flex and remain watertight. As shown best in FIGS. 2A and 2B, one or more of the gaskets 25 can include an outer dimension/diameter 25*a* that is the same as, or slightly larger than the outside diameter of the first end 31*a* of the restriction element 30. The gasket can also include an opening 25*b* that is suitable for allowing the middle 31*c* and end 31*b* portions of the restriction element 30 to be located therein.

In operation, the device 20 can be inserted through the opening 2*a* of a channel 2 of a water faucet 1. Next, the tightening member 40 can be tightened along the restriction element 30 until making contact with one of the gaskets 25. At this time, the tightening member can be further tightened so as to sandwich the gaskets 25 between the member 40 and the first end 31*a* of the restriction element 30. When such pressure is applied, the outside dimension of the gaskets 25*a* will expand until making contact with the inside surface of the channel 2, which will form a watertight seal, and thereby force the water W to flow through the aperture 32 and out of the channel 2*a*. At this time, the device shall be in a closed position.

Accordingly, the device 20 can provide a novel means of controlling the flow of water without being visible to a faucet user. Additionally, by including construction materials that are resilient to calcium, and by providing a larger aperture than conventional aerators, the inventive concepts disclosed herein can have a useful lifespan that far exceeds conventional aerators.

As described herein, the term "water faucet" is not limited to faucets which have already been installed into a building or other such structure, and can also include brand new faucets which can be installed into a building or structure with the device already in place. In other words, the device 20 can be utilized to retrofit faucets and other such fixtures, or can be installed within new fixtures at a time of the building construction or remodel, for example.

Additionally, the device 20 can be integrated into the new construction of a faucet itself, so as to reduce installation time. One suitable example of such a faucet includes U.S. Pat. No. 5,673,724, to Abel, the content of which are incorporated herein by reference.

Moreover, the inventive concepts disclosed herein are not to be construed as limiting to faucets, as the device can be utilized in conjunction with any item that dispenses water, such as sprinklers, spigots, drinking fountains and the like.

Figure 5A:
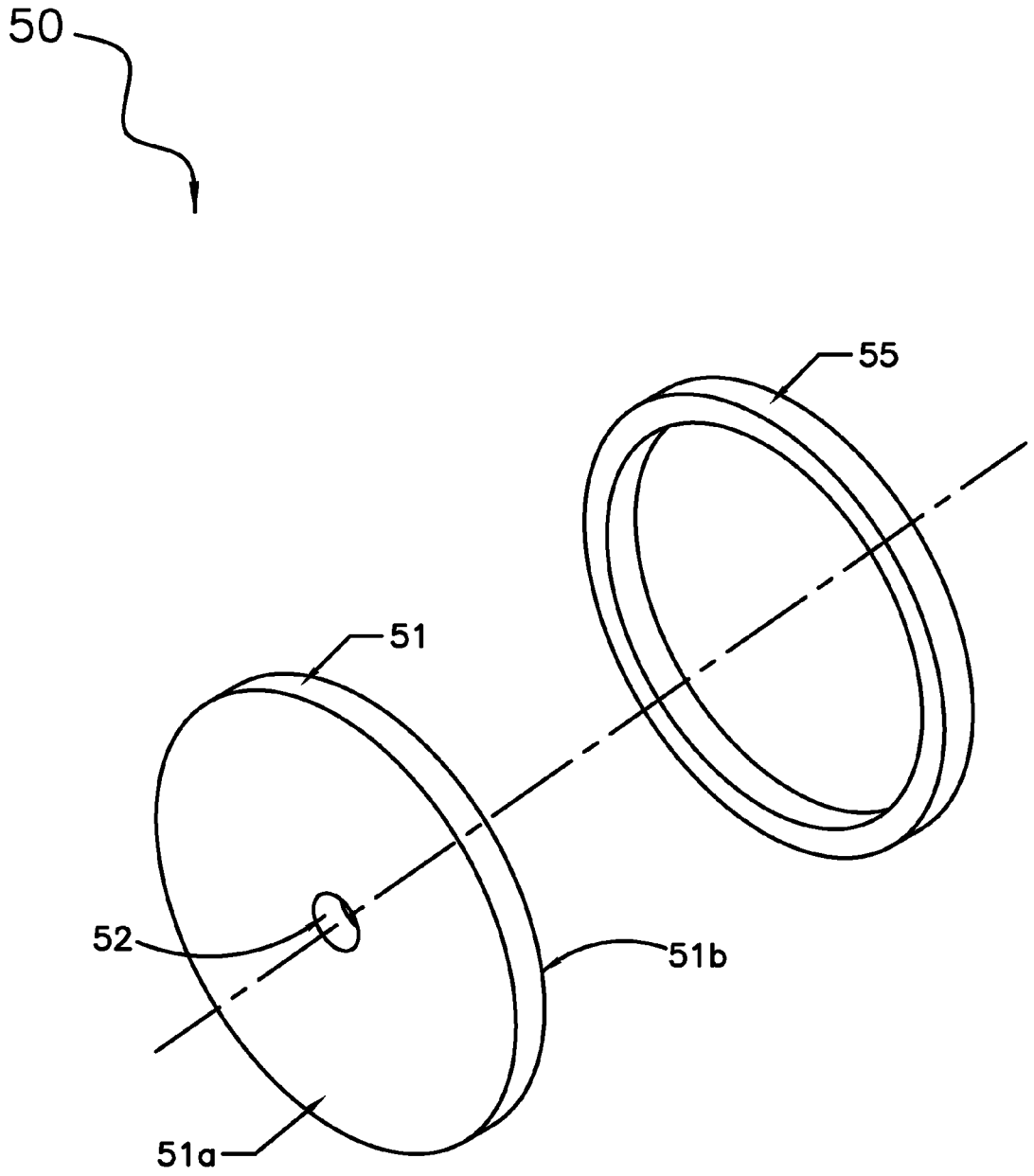
FIG. 5A is a perspective view of an internally mountable water flow device, in accordance with an alternate embodiment of the invention.
Figure 5B:
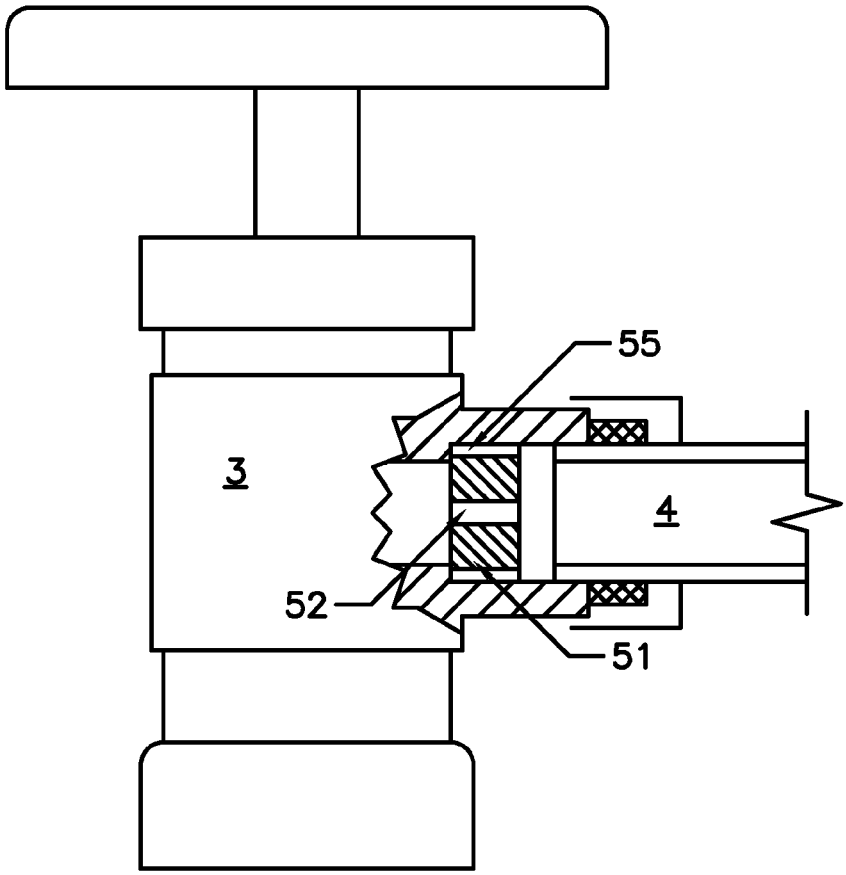
FIG. 5B is a perspective view of the water flow device of FIG. 5A in operation, in accordance with the alternate embodiment of the invention.

Accordingly, FIGS. 5A and 5B illustrate an alternate embodiment of an internally mountable water flow device 50 for use specifically with a valve. As shown, the device 50 can include a generally circular main body 51 having a first end 51*a*, a second end 51*b*, and a centrally located aperture 52. The device also including a gasket 55 having an inside diameter sufficient for mating with the outside of the main body 51 in a traditional manner.

As shown in FIG. 5B, the device can be inserted between a water source 3 (i.e., valve spigot, sprinkler adapter, hose adapter) and a water delivery device 4 (i.e., water hose, sprinkler head and the like). When so positioned, the device 50 can remain in place due to the connection between the elements 3 and 4, and can force the flow of water (not illustrated) to flow through the aperture 42 before entering the water delivery device.

As described herein, the aperture 42 can include a dimension suitable for allowing water to flow therethrough at any desirable flow and pressure level. To this end, the diameter of the aperture 42 can be predetermined based on known calculations relating to thermodynamics and can factor elements such as the PSI of the water source 3, and the size of the water delivery mechanism 4, among other factors. However, in one non-limiting embodiment, the device 50 can include an outer diameter of approximately 0.375 inches, an aperture diameter of approximately 0.084 inches, and a thickness (i.e., distance between first end 51*a* and second end 51*b*) of approximately 0.160 inches. Of course, any number of other dimensions is also contemplated.

The device 50 can also be constructed from any material suitable for prolonged exposure to water and moisture, such as PVC, CPVC, Polybutylene, PEX, and metals such as brass, copper, aluminum and stainless steel, among others, for example.

As described herein, one or more elements of the internally mountable water flow device 20 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A water flow device that is mountable internal to a water faucet, said water flow device comprising:

a water restriction element having a first end, a second end, a middle section, and a first aperture extending from the first end to the second end, said first end including a dimension that is larger than a dimension of the middle section and the second end, and said middle section including a plurality of threaded elements disposed thereon;

at least one gasket having an outside dimension that is complementary to the dimension of the first end of the water restriction element, and a centrally located opening having a dimension that is complementary to the dimension of the middle section of the water restriction element, each of said at least one gaskets being positionable at a location adjacent to the first end of the water restriction element; and a tightening member having a first end, a second end and a middle section, said member including a threaded aperture extending from the first end to the second end, said threaded aperture being complementary to the plurality of threads, and functioning to engage the gasket upon receiving a twisting motion.

2. The device of claim 1, wherein each of the water restriction element, the gasket and the tightening member are constructed to fit within a water faucet channel having a known dimension, and said restriction element is constructed from a calcium resistant material.

3. The device of claim 2, wherein the gasket includes an elastomeric construction that functions to engage the channel when the device is in the closed position.

4. The device of claim 3, wherein the water restriction element includes a dimension that is between approximately 0.1 to 0.01 inches less than the known dimension of a dimension of the water faucet channel.

5. The device of claim 1, wherein said gasket is constructed from a resilient elastomeric material that functions to expand and increase the outside dimension thereof upon being engaged by the tightening member.

6. The device of claim 5, wherein the gasket functions to expand to a dimension greater than the dimension of each of the restriction element and the tightening member when engaged by the tightening member.

7. The device of claim 1, wherein the water restriction element is constructed from a calcium resistant material.

8. The device of claim 1, wherein the tightening member includes a plurality of channels for engaging a tool and for receiving the twisting motion.

9. The device of claim 1, wherein the water restriction element includes a plurality of channels for engaging a tool to receive another twisting motion.

* * * * *